United States Patent [19]

Williams

[11] 4,014,137

[45] Mar. 29, 1977

[54] DROP ACTION PANEL ARRANGEMENT FOR OPERABLE PARTITIONS

[75] Inventor: Charles E. Williams, Delavan, Wis.

[73] Assignee: Hough Manufacturing Corporation, Janesville, Wis.

[22] Filed: Mar. 8, 1976

[21] Appl. No.: 664,440

[52] U.S. Cl. ..... 49/321; 49/127; 49/130; 52/122

[51] Int. Cl.[2] ..... E06B 7/28

[58] Field of Search ..... 49/125–130, 49/321; 52/64, 122, 127; 16/89

[56] References Cited

UNITED STATES PATENTS

| | | | |
|---|---|---|---|
| 3,235,915 | 2/1966 | Glaser | 52/64 |
| 3,295,257 | 1/1967 | Douglass | 49/127 |
| 3,400,504 | 9/1968 | Neisewander | 52/122 |
| 3,798,839 | 3/1974 | Kaufman | 49/127 |

*Primary Examiner*—Peter M. Caun
*Attorney, Agent, or Firm*—McWilliams & Mann

[57] ABSTRACT

A drop action panel arrangement for operable partitions of the multidirectional type, wherein the partition is made up of a plurality of discrete panels each having a pair of carriers riding on an overhead track to facilitate movement of the panels between the point of use and a storage area that is remote from the space being subdivided. The individual panels are vertically movable relative to their carriers and are arranged to be releasably supported on their carriers in an elevated position above the floor to arrange them for movement between points of storage and points of use. At the point of use the panels are released from dropping under gravity onto the floor for manual juxtaposition and squaring with adjacent panels to form the partition. The individual panels have adjustable base shoes for squaring of the panels, and a top seal arrangement for sealing the gap between the individual panels and the track.

13 Claims, 16 Drawing Figures

DROP ACTION PANEL ARRANGEMENT FOR OPERABLE PARTITIONS

This invention relates to a drop action panel arrangement for operable partitions, and more particularly, to a multidirectional operable partition arrangement of the type disclosed in my U.S. Pat. No. 3,879,799, granted Apr. 29, 1975.

Panels for operable partitions of this type are usually each separately supported from the track in unhinged, discrete, relation, and by a pair of carriers located adjacent but spaced from either side edge of the respective panels. The individual panels are moved between points of storage and points of use by being moved in their planes along the track straightaways, and around right angle or Y turns and across intersections, as the track layout requires.

A major problem with overhead track supported panels is that the individual partition panels as assembled in wall forming position must be square with each other in the sense that the panel side edges must be engaged from the floor to the ceiling of the space to be subdivided, to insure the effective availability of the partition acoustical rating. This requires that, among other things the track supporting the panels be level throughout its length. However, there are a number of uncontrollable factors involved in the typical installation that can all too readily result in the track going out of level after installation is completed, such as live load variations on the overhead structure to which the track is applied due to, for instance, snow or the like, building shifts due to wind loading and settling, and temperature variations. The result is that all too frequently, even though great care is taken to be sure that the track is level, after a period of use the partition will be found to operate acoustically well below its acoustical rating, due to the track having gone out of level, and the resulting failure of the individual panels to square up with adjacent panels.

Other problems with overhead track supported panels are the need to make special provision for sealing between the lower end of the panel and the floor surface, and the need to make special provison for stability in the case of panels that are to serve as doorways and have side swinging doors that impose lateral forces on the panel when the door is swung from closed to open position.

The use of so-called demountable partitions (involving discrete panels that are free of connection to overhead track) solves some of these problems from the standpoint of stability, rigidity and security, when installed in wall forming position, but panels of this type necessarily have to be moved and installed completely by manual labor, and their weight, and thus their size, must be restricted accordingly.

A principal object of the present invention is to provide an operable partition arrangement in which the panels are floor supported in their wall forming positions, but are arranged for suspension from their carriers for operable partition type ease of movement between the point of storage and point of use.

Another principal object of the invention is to provide a movable partition arrangement that combines the most desirable features of demountable partitions, from the standpoint of rigidity, stability and security, with the most desirable features of operable partitions for ease of removal or relocation of the partition.

Another important object of the invention is to provide an operable partition arrangement in which alignment or squaring of the panels is not affected by the condition of level of the track, or requires adjustment of the track or the panel carriers.

Yet another important object of the invention is to provide a drop action panel arrangement for operable partitions wherein the individual panels are releasably carried by their carriers for movement between their point of storage and position of use, and at the latter, the panels are dropped onto the floor for leveling and alignment with adjacent panels, with the dropping action effecting actuation of a top seal arrangement that effects a full and reliable acoustical seal between the panel top and the track.

Still other objects of the invention are to provide an operable panel arrangement of the drop action type having simple but reliable means for re-securing the individual panels to their carriers for ease in removal and relocation of the partition, to provide an operable partition suitable for effective use with a multidirectional track, and to provide an operable partition arrangement that is economical of manufacture, convenient to install and use, and long lived in effective operation.

In accordance with the present invention, an operable partition of the multidirectional type is provided comprising discrete panel units in which each panel unit comprises a drop action type panel having a pair of carriers riding on an overhead track to facilitate movement of the individual panel units between the point of use and the storage area that is remote from the space subdivided or to be subdivided. The panel of each panel unit is vertically movable with respect to its carriers, and is arranged to be releasably supported on its carriers at an elevated position above the floor to arrange the panel units for movement between points of storage and points of use. At the point of use, the panels of each panel unit are released for dropping under gravity onto the floor for manual juxtaposition with adjacent panels to square the panels and form the partition. The individual panels have adjustable base shoes for squaring of the panels, and a top seal arrangement for sealing the gap between the individual panels and the track, several forms of which are disclosed.

Other objects, uses, and advantages will be obvious or become apparent from a consideration of the following detailed description and the application drawings.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

Figure 1:
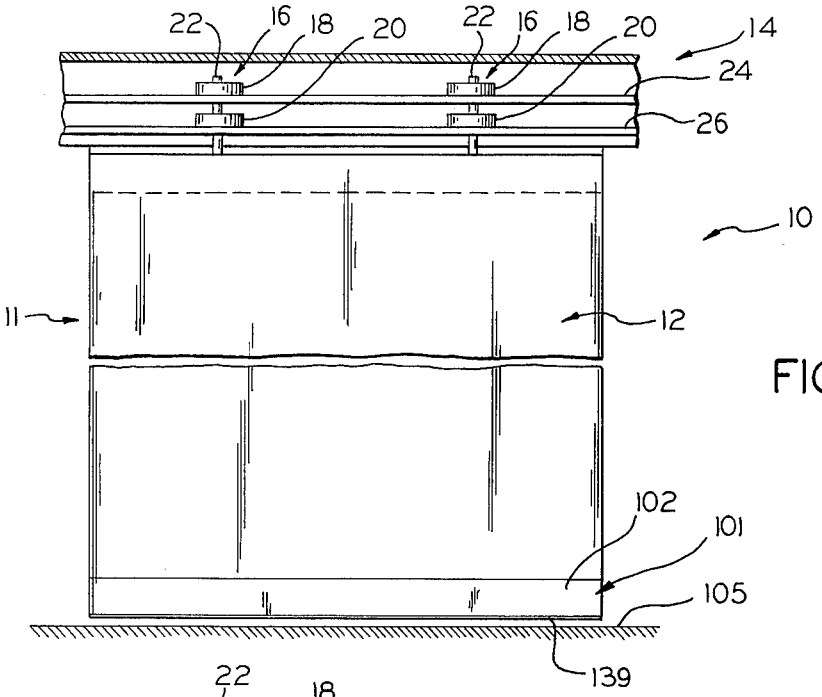
FIG. 1 is a diagrammatic side elevational view of an individual panel unit for operable partitions of the type to which the invention is applied, showing the panel unit in largely block diagram form.

In FIG. 1, reference numeral 10 generally indicates an operable partition arrangement which comprises a plurality of partiton panel units 11 (though only one is shown) each arranged to be suspended from a track 14 for movement therealong by a pair of carriers 16. The track 14 and the carriers 16 are of the general type shown in said U.S. Pat. No. 3,879,799, which involve an upper load support disc 18 and a lower load support disc 20 that are coaxially journaled on a pendant bolt 22 that is connected to the panel unit 11 it supports. The trackway 14 includes vertically spaced rollerway forming ledges 24 and 26, with one of the discs 18 riding on a ledge 24 on one side of the track, and the other disc 20 riding on the ledge 16 on the other side of the track so that the discs 18 and 20 roll in opposite directions as the panel is moved down the track 14.

Figure 2:
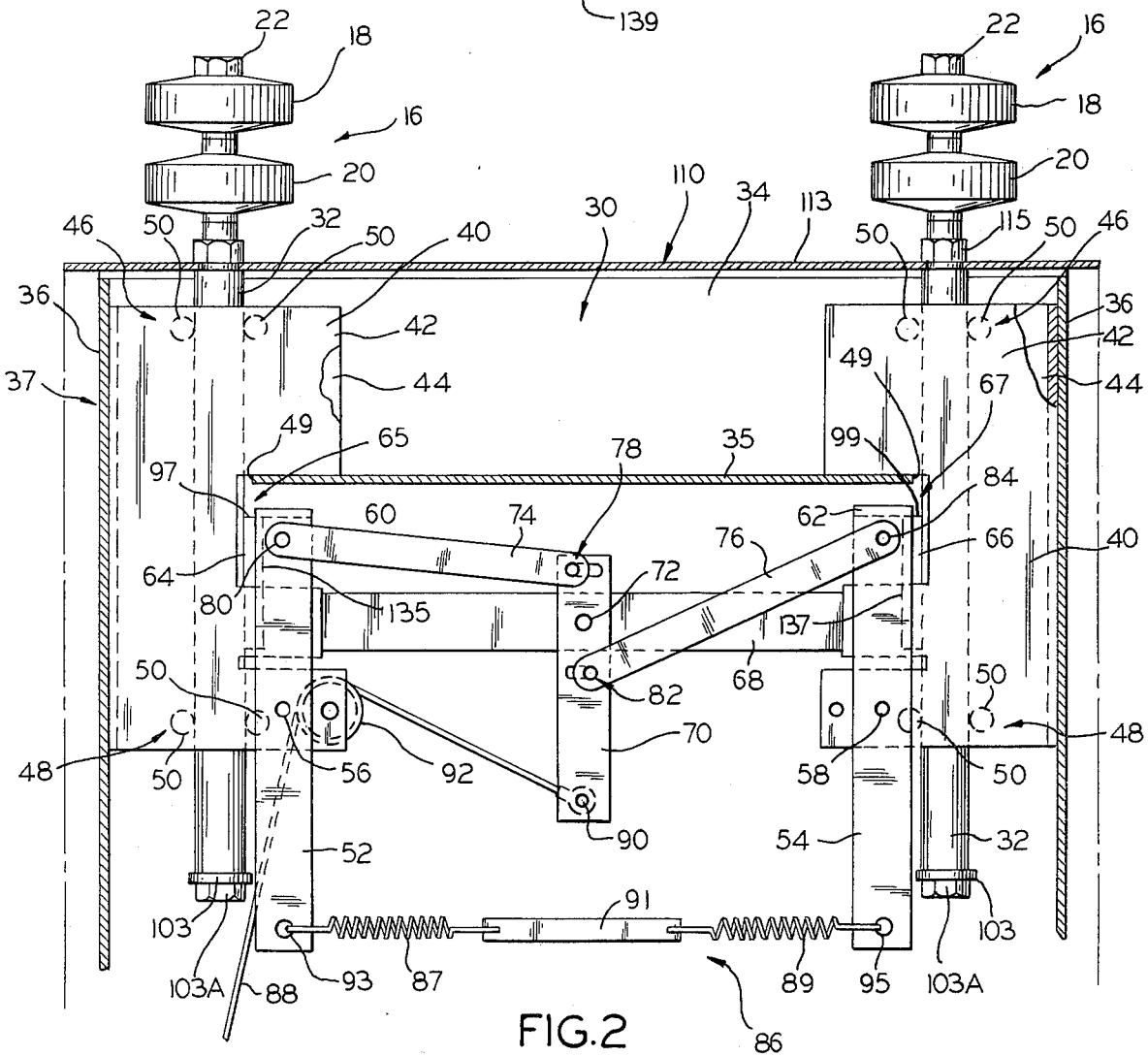
FIG. 2 is a vertical sectional view through the upper end of the panel unit, in the plane of the panel thereof, illustrating the panel latching mechanism that releasably mounts the panel on the panel unit carriers.

In accordance with the invention, each panel unit 11 of the operable partition 10 comprises a panel 12 supported by its carriers 16 through the latch mechanism 30 shown in FIG. 2, wherein the pendant bolts 22 are shown secured to the respective tubes 32 that are disposed in alignment with the bolts 22 and project downwardly into the individual panels 12 through their top frame members 34. Each panel 12 also includes opposite side frame members 36 that are suitably secured to the top frame member 34 as well as the bottom frame member 38 (see FIG. 3), as required to provide a suitably rigid panel frame 37, and suitable panel covers 39 suitably secured to frame 37. Top members 34 are of channel configuration defining a cross web 35.

At the upper end of the panel frame 38, each side frame member 36 has fixed to same a generally U-shaped bracket 40 between the sides 42 and 44 of which are secured spaced pairs 46 and 48 of guide pins 50, with the pairs of guide pins 46 and 48 of each bracket 40 being aligned vertically and spaced apart to closely receive the respective tubes 32 of the respective carriers 16 in the manner indicated in FIG. 2. The frame top member 34 is excised as at 49 to receive brackets 40 at either end of same.

The latch mechanism 30 of each panel 12 is mounted between the brackets 40 thereof and comprises a pair of swinging catch arms 52 and 54 pivotally mounted on the brackets as indicated at 56 and 58, respectively, and having their upper ends 60 and 62 respectively shaped to fit over the abutment plates 64 and 66 that are respectively secured to the respective tubes 32, as by welding or the like. The respective plates 64 and 66 form the respective detents 65 and 67 with which catch arms 52 and 54 respectivey cooperate to suspend the panel 12 from its carriers 16.

A cross bar 68 is fixed between the respective brackets 40 and pivotally mounts swing lever 70 as at 72, which is pivotally connected to the respective pull arms 74 and 76.

The arm 74 at its pivotal connection 78 to the swing arm 70 has the lost motion action indicated in FIG. 2, and has its other end pivotally connected to swing arm 52 as at 80. The arm 76 at its pivotal connection 82 to the swing arm 70 has the lost motion indicated in FIG. 2, and at its other end is pivotally connected to the swing arm 54 as at 84.

Tension spring device 86 biases the upper ends 60 and 62 of the respective catch arms 52 and 54 to swing away from each other, and pull cord 88 attached to the swing arm 70 where indicated at 90 and trained over pulley 92 (that is journalled on one of the brackets 40) and downwardly to a suitable access opening in the adjacent side frame member 36 (for access by an operator) will swing the swing levers 52 and 54 in the opposite direction, against the biasing action of the spring biasing device 86, when pulled by the operator, to free the panel from detents 65 and 67 so that it will drop under gravity onto floor surface 105. Spring device 86 comprises tension spring 87 secured at one end of rod element 91 and to swing arm 52 where indicated at 93; rod element 91 is pivotally secured to swing arm 54, as at 95.

Figure 3:
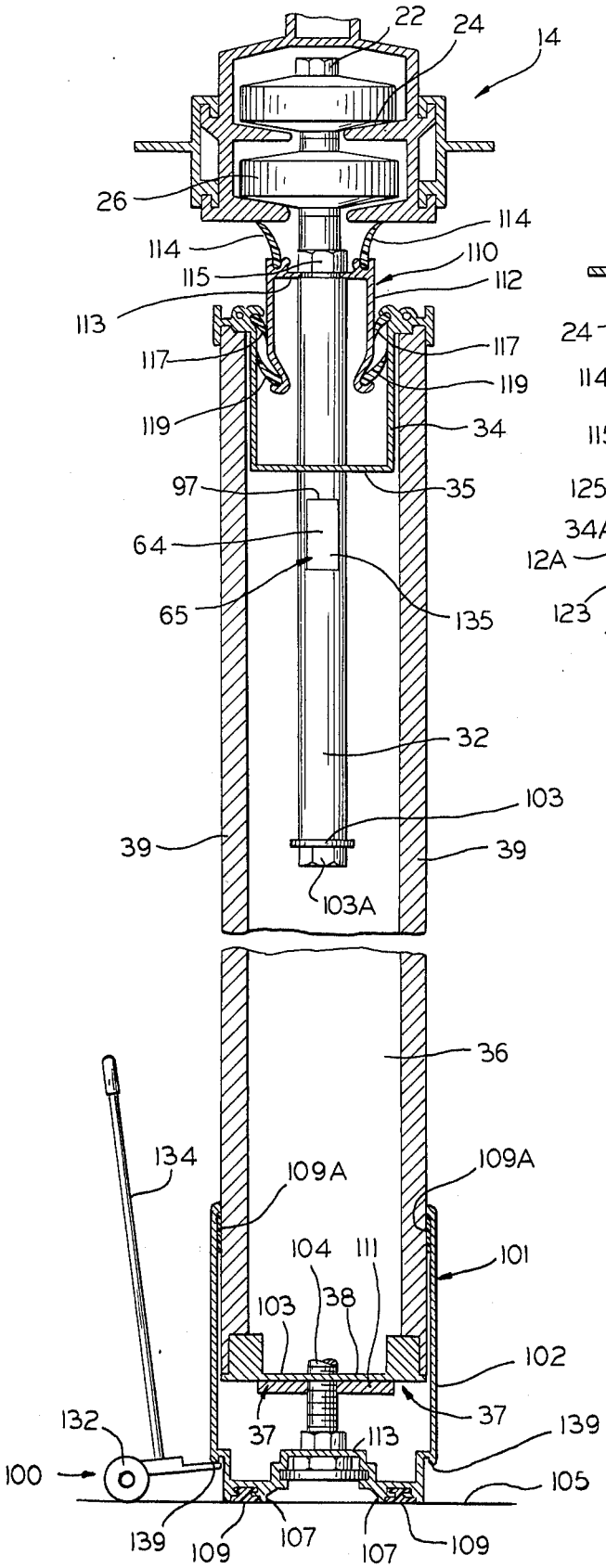
FIG. 3 is a diagrammatic vertical transverse cross-sectional view through the panel, largely in block diagram form, also illustrating a hand tool employed in this embodiment of the invention to raise the panel when the panel is to be resecured to its carriers for movement between points of use, or movement between the point of use and point of storage.
Figure 5:
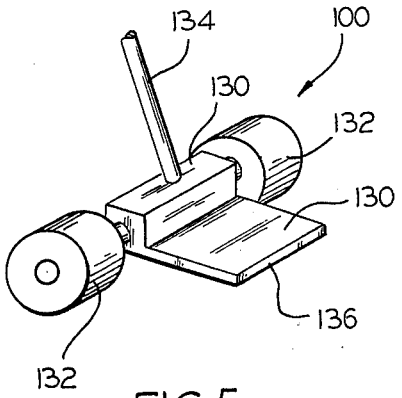
FIG. 5 is a fragmental diagrammatic perspective view of a panel hand lever lift tool or implement that is provided in accordance with the invention.

The individual panels 12 are secured to their carriers 16 for support thereby, by raising the individual panels, using the hand lever implement or tool 100 indicated in FIGS. 3 and 5, until the upper ends 60 and 62 of the swing arms 52 and 54 snap sidewise over the tops 97 and 99 of the respective support elements 64 and 66, under the action of tension spring device 86.

The individual panels 12 may now be readily moved between point of storage and point of use. When the panel has been disposed at approximatey the position it is to have in a partition to be put into wall forming relation, the operator pulls the pull cord 88 to swing the swing arm 70 to free the swing arms 52 and 54 from the respective supports 64 and 66, against the action of tensioning device 86, thereupon the panel 12 will drop under gravity to the floor, illustrated in FIGS. 1 and 3 as floor surface 105. A dropping movement of up to two inches is contemplated, tubes 32 each carrying a contingency stop comprising washer 103 (secured in place by bolt 103A) against which the respective brackets 40 will engage to limit said dropping movement relative to the carriers 16, so that in any event the panel will not completely separate from its carriers 16.

The pull cord 88 at its free end has secured thereto a suitable hand grip (not shown) that may be conveniently lodged in the frame side member 36 cord 88 is operated through, similar to the way hand grips for mechanical end seals are conventionally arranged.

Each panel 12 at its lower end is equipped with an adjusting or canting shoe 101 in the form of channel member 102 that is connected to the panel frame member 38 by a suitable bolt 104, located at approximately the middle portion (widthwise) of panel 12, with pads 106 (formed from rubber or other resilient material) being applied to the lower frame member 38 adjacent to and on either side of the bolt 104, and similar pads 108 (similar to pads 106) being applied to the lower frame member 38 adjacent each side edge of the panel. The pads 106 and 108 are interposed between the lower frame member 38 and the web 113 of channel member 102 to accommodate canting of the channel member 102 at its connection to lower frame member 38 as required to square up adjacent panels 12, and are suitably bonded in place; pads 106 as shown are affixed to a mounting plate 111 suitably fixed to frame member 38. Thus, when the panel 12 is dropped on floor surface 105 adjacent another panel 12, the operator slides the panel 12 being adjusted to bring one of its side frame members 36 against the side frame member 36 of the panel 12 already in place. The shoes 101 in resting on the floor surface 105 are flush therewith, and the limited pivotal action the shoes 101 have in the planes of their respective panels (to either side of bolt 104) permits adjacent panels to be squared with each other, regardless of the condition of level of the track 14 and floor surface 105, such that their side frame members 36 will have the desired abutting relation for good acoustical sealing characteristics.

The shoes 101 define a pair of spaced runners 107 (see FIG. 3) that provide for ready sliding on smooth surfaces. Runners 107 are formed to receive suitable sound insulating seals 109, and the shoe flanges each have sound insulating seals 109A applied thereto,.

In the embodiment of FIGS. 1–3, each panel 12 at its upper end includes an internal seal 110 in the form of channel member 112 supported by the respective carriers 16 and carrying suitable sweep seals 114 that are in constant contact with the track 14. The individual panels 12 thus move with respect to their seals 110 when the panels are raised and lowered relative to the floor. In this embodiment of the invention, the web 113 of channel member 112 is interposed between the respective tubes 32 and nuts 115 that are applied to bolts 22 (which make threaded connection to the respective tubes 32). Suitable seals 117 and 119 are applied between members 34 and 112.

Figure 4:
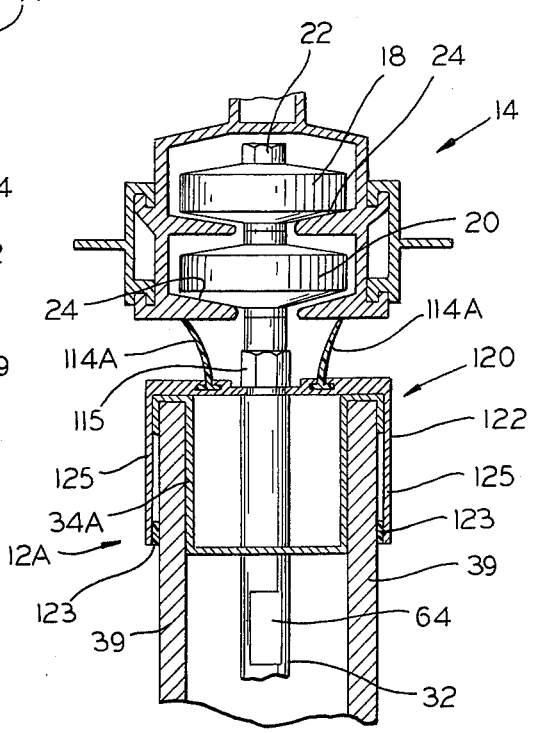
FIG. 4 is a fragmental view similar to that of FIG. 3, showing a modified form of panel arrangement.

In the panel 12A of FIG. 4, the seal 120 is of the external type, and comprises channel member 122 that is supported by the respective carriers 16 in the same manner as member 112, and fits over the top of the panel 12A involved, and specifically its top frame member 34A. The seal 120 is provided with sweep seals 114A that are in constant contact with the track and sound seals 123 along the flanges 125 of channel member 122. Panel 12A is otherwise the same as panel 12.

The tool 100 comprises an angled wheeled prying body 130 having rollers 132 on either side of same, and elongate handle 134, whereby when the projecting end 136 of the body is applied to the panel shoe 101 as indicated in FIG. 3, the panels 12 and 12A may be lifted sufficiently to bring the latching device 30 into operative engagement with the carriers 16 of the panel, and specifically with their detents 65 and 67, the swinging catch arms 52 and 54 sliding along the vertical faces 135 and 137 of the respective plates 64 and 66 until they snap over their detent forming ends. the panel shoes 101 are formed with internal shoulders or ledges 139 on either side of same for prying engagement of the end 136 of body 130 therewith.

In the panel 12B of FIG. 7 (forming panel unit 11B of partiton 10B), the latching device 30A includes the latching mechanism 30 of FIG. 2, and in addition the seal 110 is arranged to be raised and lowered in accordance with the lowering and raising of the panel 12B with respect to the carriers 16, whereby as the panel 12B is lowered, the seal 110 is raised from a position in which its seals 114 are spaced below the track 14 to a position in which its seals 114 engage the track 14 in the manner indicated in FIG. 3. When the panel 12B is raised, for movement from place to place along track 14, the seal 110 is lowered or retracted so that its individual seal elements 114 are spaced from the track 14.

For this purpose, the seal 110 has attached thereto articulation mechanisms 140 adjacent each side edge of the panel and comprising a pair of pivotal levers 142 pivotally connected to the respective carrier tubes 32 on either side of same, as at 144, and having like ends 146 of same pivotally connected as at 147 to push pull rod 148 which extends upwardly through the channel member 112 that forms seal 110 for application thereto of the securement pin 150. In the form shown, rod 148 has fixed thereto a spring seat 152 between which and a second spring seat 154 abutting the underside of the web 113 of member 112 is interposed compression spring 156 that is received about the push pull rod 148 in each mechanism 140.

The pivotal levers 142 at their ends 158 journal a roller 160 which is in operative engagement with a cam plate 162 fixed to the webs 163 of respective brackets 40A (that are similar to the brackets 40). Operatively associated with the pivotal levers 142 beneath same is cross pin 164 that is fixed between the sides 42 and 44 of brackets 40A.

Figure 7:
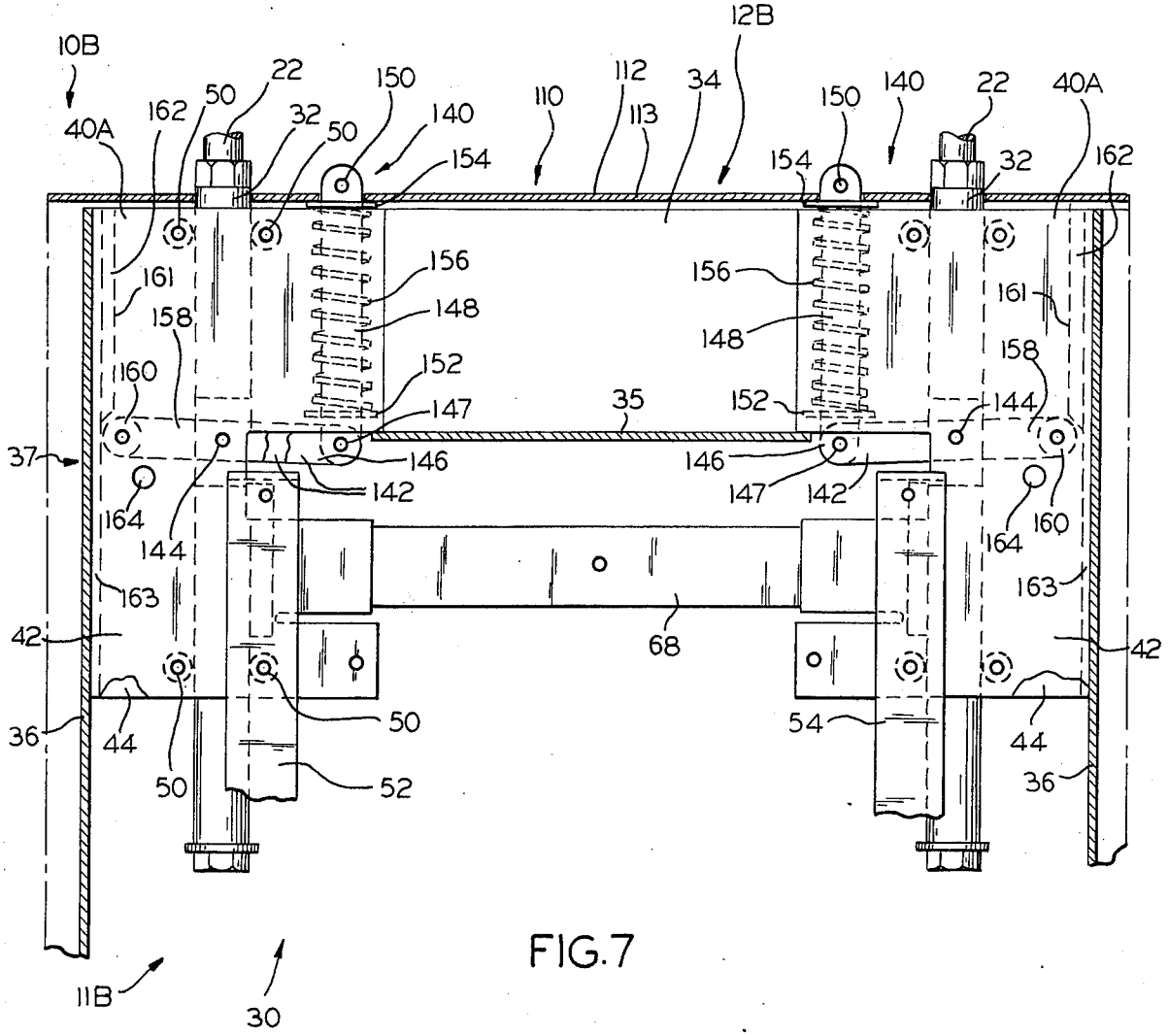
FIG. 7 is a view similar to that of FIG. 2 illustrating a modified form of the invention wherein the dropping action of the individual panels in arranging them in wall forming position actuates the panel top seal for sealing engagement with the overhead track.

In the position of FIG. 7, the panel 12B is shown supported by the carriers 16 in the manner contemplated for the showing of FIG. 2, and the seal 110 is retracted within panel 12B to space its seals 114 from track 14. On releasing the release mechanism 30, as the panel 12B moves down, under gravity roller 160 rides on cam surface 161 of cam plate 162 to swing downwardly the ends 158 of levers 142 so as to push the push pull rods 148 upwardly, simultaneously on either side of the panel 12B, whereby the seal 110 is raised to bring its seals 114 in sealing engagement with track 14. The parts are preferably proportioned so that the seal 110 will move upwardly approximately three-fourths of an inch for sealing engagement with the track, in the first three-fourths inch of drop of the panel on being released.

When the panel 12B is raised to secure the panel 12B in supporting relation from is carriers 16, as the panel and its brackets 40A raise relative to the carriers 16, the rollers 160 ride down the respective cam plates 162 and are engaged by return pins 164 that move the ends 158 of levers upwardly to fully return the seal 110 to retracted position.

The panel 12B is otherwise the same as panel 12, though the top seal may be of either the external or internal type, and of course the latch mechanism of either FIGS. 2 or 7 may be employed.

Figure 6:
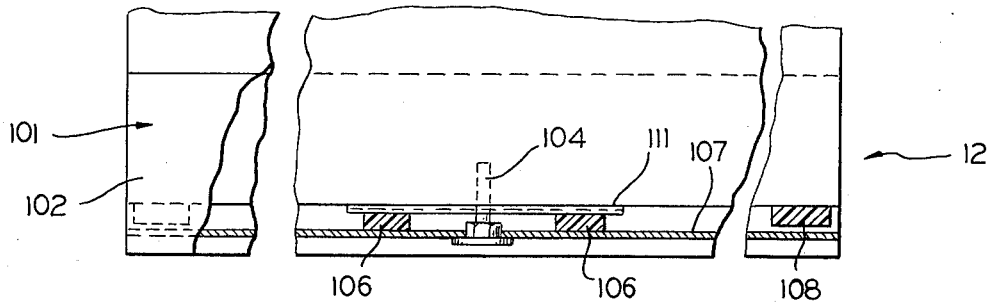
FIG. 6 is a fragmental side elevation of the lower end of the panel, with parts broken away, illustrating one form of adjustable panel shoe in accordance with the invention.
Figure 8:
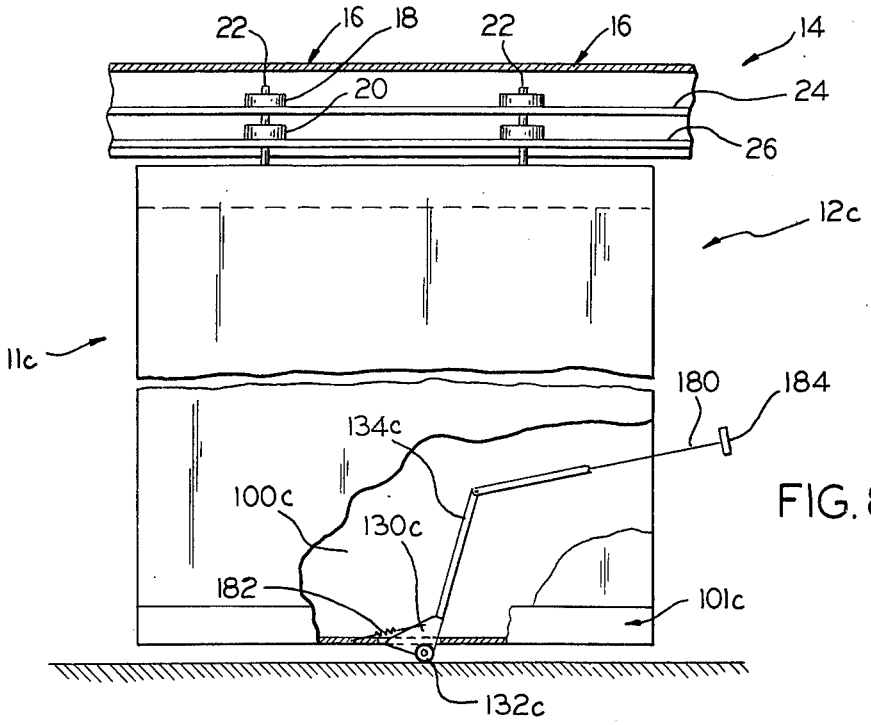
FIG. 8 is a view similar to that of FIG. 1, but with parts broken away and illustrating a further modified form of the invention in which the panel hand lever lift tool or implement is built into the panel.
Figure 9:
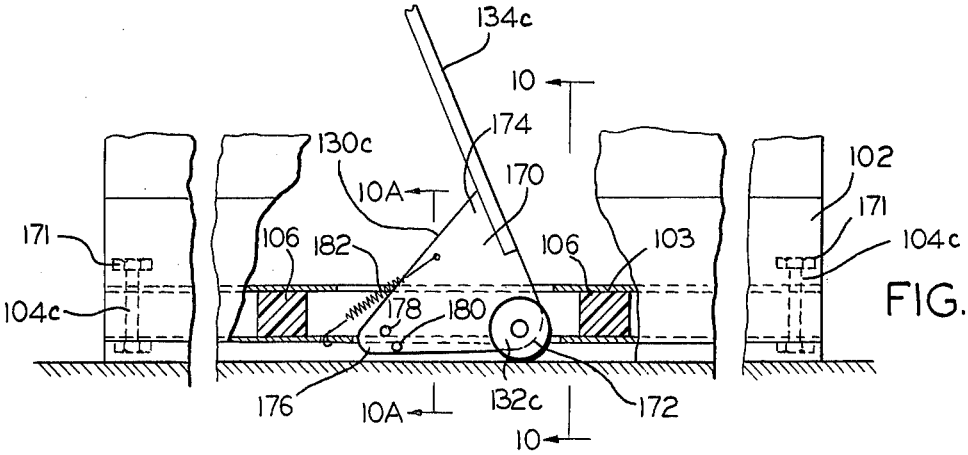
FIG. 9 is a view similar to that of FIG. 6, but showing the embodiment of FIG. 8.
Figure 10:
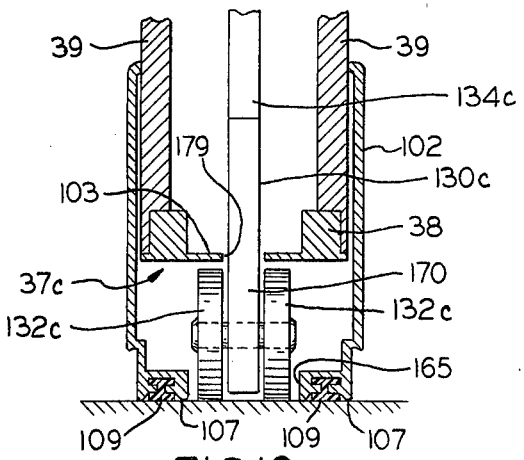
FIG. 10 is a fragmental cross-sectional view taken substantially along line 10—10 of FIG. 9.
Figure 10A:
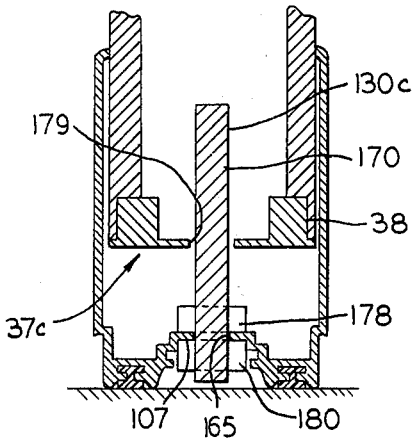
FIG. 10A is a view similar to that of FIG. 10 but taken along line 10A—10A of FIG. 9.

In the panel 12C of FIGS. 8–10 (forming panel unit 11C of partition 10C), the panel includes built in hand lever implement or tool 100C operably associated with shoe 101C. The frame 37C of panel 12C is the same as frame 37, with the shoe 101C being loosely connected to the frame lower member 38 at either end of same by suitable bolts 104C (bolts 104C being applied to shoe 101C similar to the manner indicated in FIG. 3 with friction nuts 171 positioned thereon to allow limited rocking action of the shoe), with pads 106C (similar to pads 106) being applied to frame member 38 on either side of its midportion, so that shoe 101C rocks in the plane of panel 12C similar to the arrangement of FIG. 6. Between the rubber pads 106C, shoe web 107is excised to define a T-shaped slot 165 that receives the body 130C of tool 100C and its wheels 132C. Body 130C is in the form of a vertically disposed flat triangular plate 170 having its wheels 132C journaled at one of its apexes 172 and operating handle 134C affixed to plate 170 at its upright apex 174. Plate 170 at its apex 176 has fixed thereto a pair of spaced apart cross pins 178 that span slot 165 and embrace the shoe web 107 on either side of plate 170, as indicated in FIG. 10A, to serve as a prying and lifting connection to panel 12C.

Plate 130C extends up into panel 12C through a slot 179 formed in lower frame member 38 to dispose handle 134C within panel 126 for swinging movement in the plane of panel 12C between the two positions indicated by FIGS. 8 and 9 to shift the panel 12C from lowered to raised, carrier supported, position, with the operator pulling on pull cord 180 for this purpose. On release of latch mechanism 30, tool 101C is biased to the position of FIG. 9 by the weight of the panel 12C acting on lower cross pin 180. When the panel 12C is raised, tool 100C is retained substantially in the position of FIG. 9 by suitable tension spring 182 being connected between plate 170 and shoe 101C, as indicated in FIG. 9. Pull cord pull handle 184 is suitably lodged in the side frame member 36 through which cord 180 extends until needed.

Of course, the latch mechanism 30 of panel 12C may be arranged as shown in either FIG. 2 or FIG. 7.

In the embodiment of FIGS. 11–14, reference numeral 21, generally indicates an operable partition arrangement which comprises a plurality of partition panel units 11D each comprising a panel 12D suspended from track 14 by a pair of carriers 16, as in the embodiment of FIGS. 2–3.

Each panel 12D if the operable partition 210 is supported by its carriers 16 through the latch and lift mechanism 230. As in panel 12, the pendant bolts 22 are secured to the respective tubes 32 that are disposed in alignment with the bolts 22 and project downwardly into the individual panels 12D through their top frame members 34. Each panel 12D also includes opposite side frame members 36 that are suitably secured to the top frame member 34 as well as the bottom frame member 38 (not shown), as required to provide the aforedescribed panel frame 37 (which is shown largely in block diagram form). Panels 12D are each equipped with a shoe 101 in the same manner as panel 12 (see FIG. 6).

At the upper end of the panel frame 37 (of panel 12D), each side frame member 36 has fixed to same a parallel plate corner bracket 240 between the sides 242 and 244 of which are secured the spaced pairs 46 and 48 of guide pins 50 of panel 12 that receive the respective tubes 32 of the respective carriers 26 in the manner already described.

The plates 242 and 244 are suitably fixed, as by welding, to either side of the respective angle members 245 secured to the frame 37 by suitable screws 247.

The latch and lift mechanism 230 of each panel 12D is mounted between the brackets 240 thereof. Below the brackets 240 the frame 37 carries a pair of shaft journaling brackets 251 that are suitably fixed to the respective panel side frame members 36; the brackets 251 journal between them shaft 252, while stub shafts 254 and 256 are journaled between the respective frame members 36 and the respective brackets 251 in coaxial relation to shaft 252. Stub shaft 254 and shaft 252 are fixed, as by welding, to channel shaped lever arm 258, while shaft 252 and stub shaft 256 have similar channel shaped lever 260 fixed thereto, as by welding and in parallelism to lever 258. Levers 258 and 260 are respectively pivotally connected to the respective throw arms 262 and 264 by the respective pins 266 and 268.

The throw arms 262 and 264 are respectively pivotally connected, as at 263 and 265, respectively, to the respective levers 267 and 269 each pivotally connected to their respective brackets 240 as at 270. The levers 267 and 269 each comprise a pair of plates 272 (see FIG. 14) having a common pivot connection at 270 and disposed on either side of the respective tubes 32 and cooperating with the respective fulcrum pins 274 and 276 fixed to the respective tubes 32, whereby as the levers 258 and 260 are swung from the position of FIG. 12 to the position of FIG. 11, as by using removable hand tool 278 keyed to stub shaft 254, levers 267 and 269 rock on pins 274 and 276 respectively to lift the panel 12D off the floor surface 104, with the panel 12D being held in its raised position (in which it is supported by its carriers 16) by the levers 258 and 260 moving to an overcenter position relative to shaft 252 and the respective throw arms 262 and 264.

The individual panel units 11D may now be readily moved as needed, for instance, to another location, or between points of storage and point of use; when the panel 12D has been disposed at approximately the position it is to have in the partition, the operator uses tool 278 to swing the swing levers 258 and 260 out of their overcenter positions and lower the panel 12 to the floor. A lowering movement of up to 2 inches is contemplated, with the upper sets 46 of guide pins 50 and the rock pins 274 and 276 serving as stops limiting downward movement of the panel 12D relative to its carriers 16.

Figure 14:
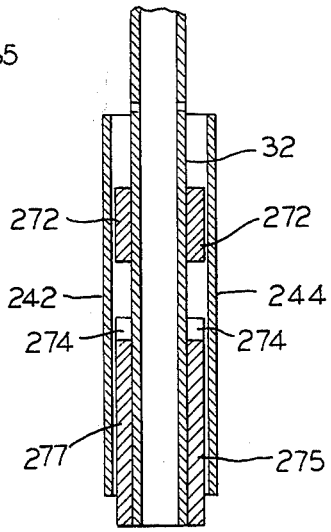
FIG. 14 is a fragmental cross-sectional view taken substantially along line 14—14 of FIG. 11 illustrating another detail of construction of that embodiment of the invention.

Fulcrum pins 274 and 276 as shown are braced by abutment plates 275 and 277 (see FIG. 14) respectively fixed to the sides of the respective tubes 32 below same (as by welding), as indicated in FIG. 14. Hand tool 278 comprises a hub 281 formed to fit over the cranking ends 282 and 284 of stub shafts 254 and 256, and receive their keying pins 286, for cranking relation thereto under leverage supplied by the operator applying hand torque to hand lever 288. Thus, shaft 252 can be operated from either edge of the panel 12D, and the stub shaft ends 282 and 284 project through the webs 290 of the frame side members 36 for this purpose (members 36 being of channel shaped configuration).

Each panel 12D as illustrated includes the internal seal 110 of FIG. 3 (shown in dashed lines in FIGS. 11 and 12) comprising channel member 112 carrying seals 114 that are to contact the track 14 when the panel 12D is lowered to the floor. However, the top seal obviously may be of the external type respresented by the showing of FIG. 4.

In the panel 12D, the device 230 includes the aforementioned panel raising and lowering arrangement, and in addition the top seal 110 is arranged to be raised and lowered in accordance with the lowering and raising of the panel 12D with respect to the carriers 16, whereby as the panel is lowered, the top seal 110 is raised to a position in which its seals 114 engage the track 14 in the manner indicated in FIG. 3. When the panel 12D is raised for movement from place to place, the top seal 110 is lowered or retracted so that its individual seal elements 114 are spaced from the track 14.

For this purpose the top seal 110 has attached thereto articulation mechanism 190, which comprise, at each side edge of the panel, the levers 267 and 269 having like ends 292 of same extended and pivotally connected as at 294 to, and on either side of, headed push pull rod 298 which extends upwardly through frame member web 35 and the web 113 of the channel member 112 that forms the top seal 110 as well as the washer type spring seat 302 underlying web 113. Rod 298 has fixed thereto a second spring seat 304, with compression spring 306 being interposed between the seats 302 and 304 and about the respective rods 298.

Figure 11:
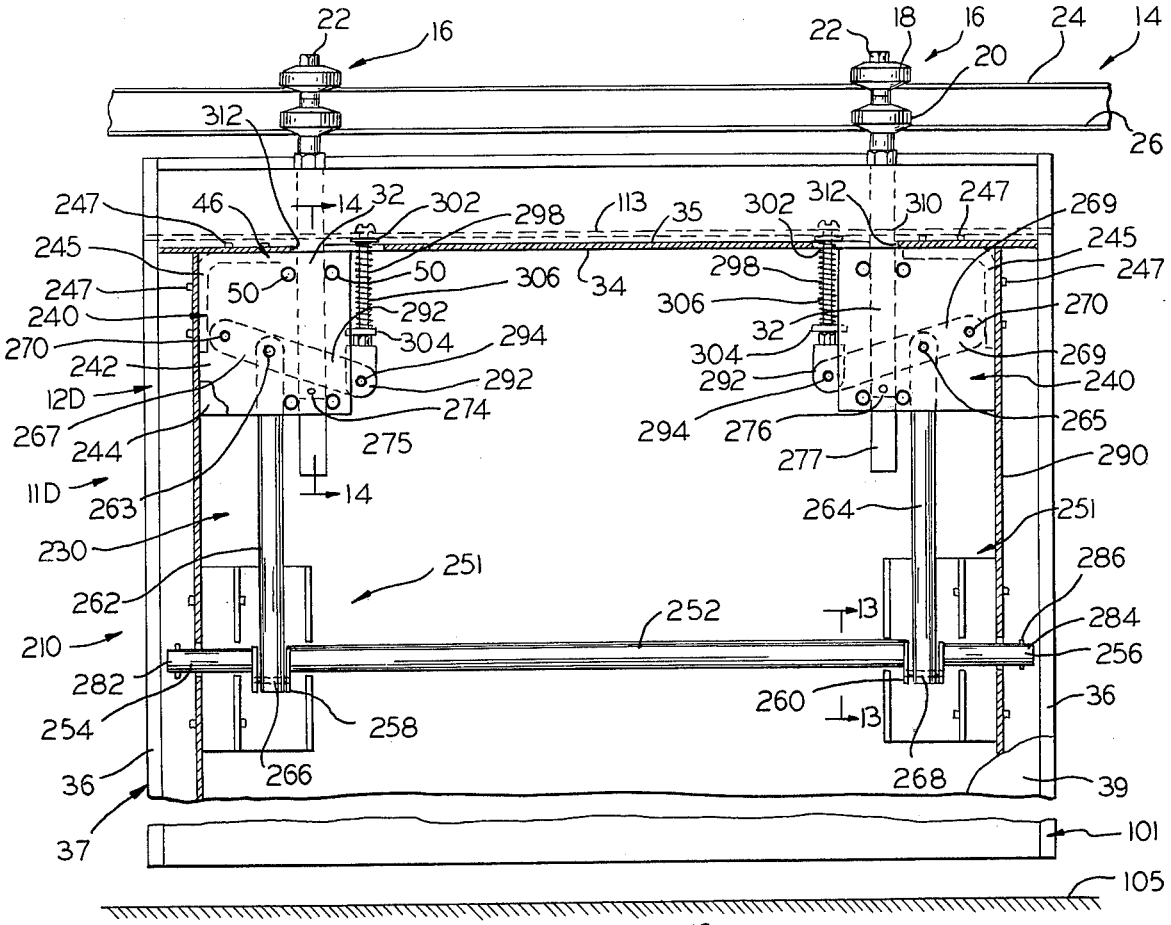
FIG. 11 is a view similar to that of FIGS. 1 and 8, but on a somewhat enlarged scale and with the panel covers largely omitted to diagrammatically illustrate a modified form of built in panel lift arrangement, with the panel being shown in its elevated relation.
Figure 13:
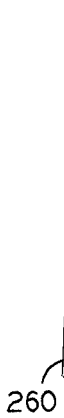
FIG. 13 is a fragmental cross-sectional view taken substantially along line 13—13 of FIG. 11 illustrating a detailed construction of the panel mechanism of the embodiment of FIGS. 11 and 12.
Figure 13A:
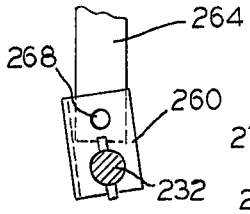
FIG. 13A is a view similar to that of FIG. 13 but showing the panel in raised position.

In the position of FIG. 11, the panel 12D is shown supported by the carriers 16, and the top seal 110 is retracted to the extent that the seal web 113 is adjacent frame member web 35. On actuating the mechanism 230 to lower the panel 12D, as the panel 12D moves down, the levers 266 and 268 have their ends 292 swung upwardly so as to push the actuating rods 298 upwardly, on either side of the panel 12D. The parts are preferably proportioned so that the top seal 110 will move upwardly approximately three-fourths of an inch for sealing engagement with the track 14, in the first three-fourths inch of drop of the panel on being released.

Figure 12:
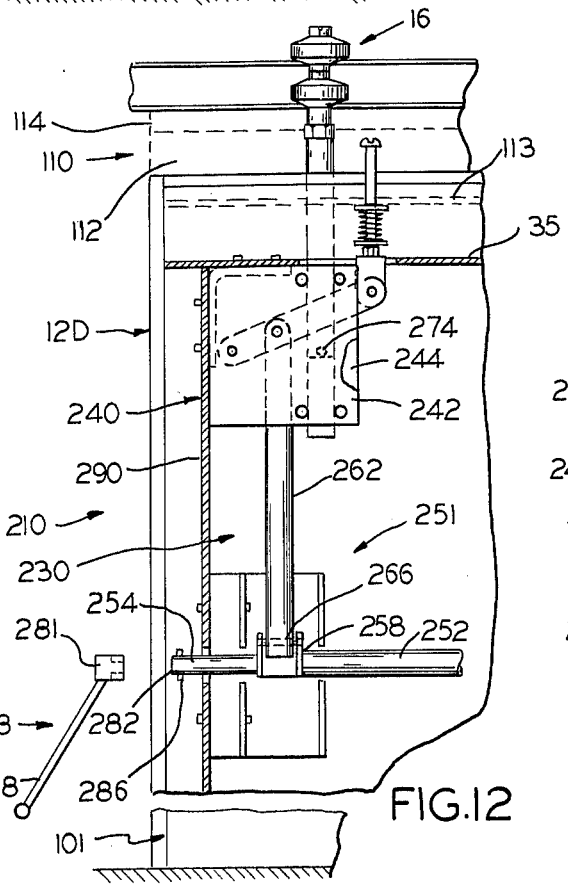
FIG. 12 is a view similar to that of FIG. 11, but showing only one side of the panel and illustrating the panel in its lowered or floor supported relation.

When the panel 12D is raised to secure same in supporting relation from the carriers 16, as the panel and its brackets 240 rise relative to the carriers, the ends 292 of levers 266 and 268 swing downwardly to fully return the top seal 110 to retracted positon (FIG. 12).

The brackets 240 are secured to both the top and side frame members 34 and 36. The top seal web 113 is apertured as at 310 to receive tubes 32 and the headed ends of push pull rods 298, and the top frame member web 35 is excised as at 312 to accommodate the tubes 32 and push pull rods 298. Of course, the top seal arrangement illustrated by the showing of FIG. 4 may be used in panel 12D instead of the internal seal illustrated.

It will therefore be seen that the partition arrangement of this invention has a number of important advantages.

For instance, being associated with and applicable to multidirectional track of the type represented by track 14 provides complete flexibility of partition layout. The panels of the respective panel units when supported on their carriers are readily moved between the point of storage and point of use, or between and old and new site of use with all the facility of an operable partition.

When the individual panels have been moved to their desired wall forming location, they are individually lowered to the floor by operation of the drop action mechanism herein disclosed. Adjacent panels can be readily slid on their runners as is necessary to bring their side edges into juxtaposition, and the adjustable shoes of the respective panels permit ready squaring of the panel side edges in the assembly of the partition to its wall forming relation. In the form of the invention where the top seal is stationary with the panel carriers, the top seal is at all times in sweep sealing relation with the track. In the forms of the invention whereby the top seals extend and retract as the individual panels are lowered and raised, which are the preferred embodiments, the lowering of the panels automatically brings the top seals into sealing relation with the underside of the track, and raising of the panels for support of same by their carriers automatically retracts the seals so that the panels are readily moved free of wiping engagement with the track.

When the panels are in their wall forming positions, the full weight of the panels rest on the floor or other supporting surface therefor. Thus, the panel carriers, and therefore the track, do not carry the weight of the panels once the panels are set in their wall forming positions. This has the advantage of freeing panel alignment from being affected by the condition of level of the track, while at the same time still providing a laterally bracing connection or tie with the track for maximum lateral load resisting conditions. Squaring of the individual panels is easy by way of their adjustable connection with their shoes which is only that necessary to accommodate out of level conditions that the floor or other supporting surfaces may have. The panels herein disclosed have their frame side frame members 38 suitably equipped for acoustical sealing purposes in any suitable manner, such as that shown in U.S. Pat. No. 3,638,376.

Panels that are designed to provide pass doors may have the lower end of the doorway defined by a threshhold of minimum height as mechanical seals at the lower end of the panel are not required for either sealing or stability. Accessories such as shelves, clip-on chalkboards, desks, cabinets, etc. can be hung on the individual panels or on the complete partition, with the added load being transmitted directly to the floor rather than to the overhead structure.

Again, as to panels that are designed to serve as pass doors, the full weight of the panel on the floor surface will be available to offset any lateral reaction forces applied to the panel by the swinging of the pass door from closed to open position. In conventional panel arrangements some type of brace or support leg arrangement is required to hold the pass door forming panel restrained against movement as the pass door is operated.

The fact that the weight of the individual panels is on the floor surface rather than on the track, when the partition is in its wall forming relation, allows for simplification of track design. Since squaring of the panels is achieved by virtue of their adjustable connection with their shoes, uncontrollable conditions effecting track level, such as live load variations, building shifts due to wind loading and settling, temperature variations and the like, will no longer affect the acoustical rating of the assembled partition.

An assembled partition made up of the panels of the present invention may be readily disassembled and removed or located as desired.

In short, the invention has the effect of combining the most desirable features of typical demountable partitions from the standpoint of rigidity, stability and security, with the most desirable features of operable partitions from the standpoint of ease of partition assembly, removal, or relocation of the complete partition, and on short notice.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In an operable panel type partition arrangement including a plurality of discrete panel units an overhead tract defining the path of movement of the panel units over a support surface, and a pair of carriers for each panel unit riding on the track for movement of the respective panel units along the track, the improvement wherein said panel units each comprise:

a panel vertically movable relative to the panel unit carriers, said panel including means for releasably supporting same on the panel unit carriers to suspend said panel from the track in a raised position above the support surface for movement along the track over the support surface, means for accommodating dropping of the panel under gravity onto the support surface on release of said supporting means to operatively dispose the panel between the track and the support surface, said panel including top seal means including a top seal for closing the gap between the panel and the track, said releasable supporting means comprising:

each of said carriers of said panel carrying a detent in fixed relation thereto, said panel having adjacent each carrier a catch arm mounted on the panel for movement into engagement with the detent adjacent same for supporting the panel therefrom in said panel raised position, and means for moving said catch arms out of engagement with the respective detents to effect release of said supporting means.

2. The improvement set forth in claim 1 wherein:

said catch arms are spring biased into engagement with the respective detents, and wherein said moving means for said catch arms includes means for effecting simultaneous movement of said catch arms of said engagement with said detents.

3. The improvement set forth in claim 2 wherein:

said panel top seal is mounted on the panel for vertical telescoping movement with respect thereto, and wherein said top seal means includes means articulated with said panel, said carriers, and said top seal for moving said panel top seal into sealing relaton with the track on release of said supporting means.

4. In an operable panel type partition arrangement including a plurality of discrete panel units, a overhead track defining the path of movement of the panel units over a support surface, and a pair of carriers for each panel unit riding on the track for movement of the respective panel units along the track, the improvement wherein said panel units each comprise:

a panel vertically movable relative to the panel unit carries, said panel including means for releasably supporting same on the panel unit carriers to suspend said panel from the track in a raised position above the support surface for movement along the track over the support surface, means for accommodating dropping of the panel under gravity onto the support surface on release of said supporting means to operatively dispose the panel between the track and the support surface, said panel including top seal means including a top seal for closing the gap between the panel and the track, and means for raising said panel to its raised position, said raising means comprising:

a hand lever implement including wheeled prying means for making a purchase between the panel and the supporting surface for manually raising said panel to its said raised position using said implement.

5. The improvement set foth in claim 4 wherein:

said implement is discrete from the panel.

6. The improvement set forth in claim 4 wherein:

said implement is built into the panel for movement along the track therewith.

7. In an operable panel type partition arrangement including a plurality of discrete panel units for forming the partition, an overhead track defining the path of movement of the panel units over the partition support surface, and a pair of carriers for each panel unit ridng on the track for mounting the panel unit on the track for movement of the respective panel units along the track, the improvement wherein said panel units each comprise:

a panel having a height that is less than the vertical spacing between the track and the support surface, means for securing said panel to the panel unit carriers for vertical free fall lost motion movement relative to the panel unit carries between a raised position above the support surface and a lowered position in which the panel rests on the support surface in its partition forming relation, means for raising said panel against gravity from its lowered position to its raised position, said panel and carriers of said unit including means for supporting the panel on the panel unit carriers at said raised position, and against gravity, for movement of the panel unit along the track over the support surface, and means for freeing the panel from support by the panel unit carriers for effecting free fall of the panel from its raised position to its lowered position, said panel at its upper end including top seal means for acoustically sealing same between the panel upper end and the track when the panel is in its lowered position.

8. The improvement set forth in claim 7 wherein:

said panel top seal means comprises a top seal that is carried by and is stationary with respect to the panel unit carriers, said top seal and said panel being in telescoping relation to accommodate said vertical movement of the panel relative to the panel unit carriers.

9. The improvement set forth in claim 7 wherein:

said panel top seal means comprises a top seal that is mounted on the panel upper end for vertical telescoping movement with respect thereto between an extended position in sealing relation with the track and a retracted position spaced from the track, said top seal being articulated to said panel unit for movement to its extended position when said panel is moved from its said raised position to its said lowered position and for movement of the top seal to the retracted position thereof on movement of the panel from its lowered position to its raised position.

10. The improvement set forth in claim 7 wherein:

said panel at its lower end includes a shoe connected thereto at its lower end for accommodating canting of said shoe relative to said panel, when said panel rests on the supporting surface for accommodating squaring of the panel to the panel of a panel unit adjacent same.

11. The improvement set forth in claim 7 wherein:

said raising means comprises:

a hand lever implement including wheeled prying means for making a purchase between the panel and the supporting surface for manually raising said panel to its said raised position using said implement.

12. The improvement set forth in claim 7 wherein:

said raising means comprises:

a rock shaft journalled in said panel for rocking movement about a substantially horizontal axis coplanar with said panel, said rock shft having lever arm means fixed thereto, and thrust arm means articulated between said lever arm means, at least one of said carriers, and said panel for moving said panel vertically on rocking of said rock shaft.

13. In a panel unit for an operable panel type partition arrangement including an overhead track defining the path of movement of the panel unit over the partition support surface between points of storage and use, with the panel unit including a panel and a pair of carriers for each panel unit riding on the track for mounting the panel unit on the track for movement of the panel unit along the track, the improvement wherein:

the panel has a height that is less than the vertical spacing between the track and the support surface, means for securing said panel to the panel unit carriers for vertical free fall lost motion movement relative to the panel unit carriers between a raised position above the support surface and a lowered position in which the panel rests on the support surface in its partition forming relation, means for raising said panel against gravity from its lowered position to is raised position, said panel and carriers of said unit including means for supporting the panel on the panel unit carriers at said raised position, and against gravity, for movement of the panel unit along the track over the support surface, and means for freeing the panel from support by the panel unit carriers for effecting free fall of the panel from its raised position to its lowered position, said panel at its upper end including top seal means for acoustically sealing same between the panel upper end and the track when the panel is in its lowered position.

* * * * *